US011419408B2

(12) United States Patent
Kuperaza

(10) Patent No.: US 11,419,408 B2
(45) Date of Patent: Aug. 23, 2022

(54) SYSTEM AND METHOD FOR A COSMETIC PRODUCT USED FOR APPLICATION OF FOUNDATION USING A SYRINGE PLUNGER TYPE DISPENSING MECHANISM

(71) Applicant: Sylvia Evelyn Kuperaza, Lubbock, TX (US)

(72) Inventor: Sylvia Evelyn Kuperaza, Lubbock, TX (US)

( * ) Notice: Subject to any disclaimer, the term of this patent is extended or adjusted under 35 U.S.C. 154(b) by 0 days.

(21) Appl. No.: 16/855,411

(22) Filed: Apr. 22, 2020

(65) Prior Publication Data

US 2020/0383463 A1 Dec. 10, 2020

Related U.S. Application Data

(63) Continuation-in-part of application No. 15/938,798, filed on Mar. 28, 2018, now Pat. No. 10,687,600.

(51) Int. Cl.

| | |
|---|---|
| ***A46B 11/00*** | (2006.01) |
| ***A46B 9/02*** | (2006.01) |
| ***A46B 9/00*** | (2006.01) |
| ***A45D 40/26*** | (2006.01) |
| ***A45D 34/04*** | (2006.01) |
| ***B65D 83/00*** | (2006.01) |

(52) U.S. Cl.

CPC ..... *A46B 11/0055* (2013.01); *A45D 34/042* (2013.01); *A45D 40/262* (2013.01); *A46B 9/005* (2013.01); *A46B 9/021* (2013.01); *B65D 83/0022* (2013.01); *A46B 2200/1046* (2013.01)

(58) Field of Classification Search

CPC .... A45D 34/04; A45D 34/042; A45D 34/045; A45D 40/262; B05C 17/005; B05C 17/00503; B05C 17/00576; B05C 17/00583; B05C 17/00593; B05C 17/01; B05C 17/0053; A46B 11/002; A46B 11/0055; A46B 11/001; A46B 1/0024; A46B 11/0037; A46B 9/021; A46B 9/005; A46B 2200/1046; B65D 83/0022

USPC ..... 401/171, 176, 177, 179, 270, 150

See application file for complete search history.

(56) References Cited

U.S. PATENT DOCUMENTS 1,896,589 A * 2/1933 Mulhollen ..... A46B 11/002 401/176

2,136,979 A 11/1938 Mureau (Continued)

FOREIGN PATENT DOCUMENTS

JP 2004065467 A 3/2004

*Primary Examiner* — David J Walczak

(74) *Attorney, Agent, or Firm* — Michael Roebuck; Moster Craft PC

(57) ABSTRACT

An apparatus including but not limited to a plunger driven dispenser comprising a handle having an inner section and an outer section and a top; a storage chamber formed inside of the inner section the contains a highly viscous product, wherein the storage chamber has a tapered opening at the bottom and an aperture in the top of the storage chamber, wherein the aperture further comprises a coned tip surrounding the aperture; a syringe and plunger formed inside of the outer section that fits into the storage chamber and extrudes the cosmetic product through the coned tip aperture under pressure applied to the plunger; and an aperture in the top that receives cosmetic product from the storage chamber through the coned tip aperture and a spike to seal the storage chamber.

20 Claims, 12 Drawing Sheets

(56) References Cited

U.S. PATENT DOCUMENTS

| | | | | |
|---|---|---|---|---|
| 2,145,570 | A * | 1/1939 | Miettunen | A46B 11/002 401/176 |
| 2,272,641 | A | 2/1942 | Mureau | |
| 2,996,223 | A * | 8/1961 | Dolezal | F16N 3/12 222/327 |
| 4,521,128 | A * | 6/1985 | O'Neal | A46B 11/0079 401/183 |
| 6,729,789 | B2 * | 5/2004 | Gordon | A46B 11/0017 15/111 |
| 8,794,249 | B2 | 8/2014 | Gerber | |
| 8,840,332 | B2 | 9/2014 | Lhoyer | |
| 2008/0115796 | A1 | 5/2008 | Montanari et al. | |
| 2009/0020551 | A1 | 1/2009 | Malvar et al. | |
| 2010/0239354 | A1 | 9/2010 | Chen | |
| 2012/0192886 | A1 | 8/2012 | Singer | |
| 2012/0321368 | A1 | 12/2012 | Lim | |

* cited by examiner

SYSTEM AND METHOD FOR A COSMETIC PRODUCT USED FOR APPLICATION OF FOUNDATION USING A SYRINGE PLUNGER TYPE DISPENSING MECHANISM

CROSS REFERENCE TO RELATED APPLICATIONS

This patent application is a Continuation in Part of U.S. patent application Mar. 28, 2018 now U.S. Pat. No 10,687,600 by Kuperaza entitled "A System and Method for a Cosmetic Product Used for Application of Foundation Using A Plunger Type Dispensing Mechanism" which is hereby incorporated by reference in its entirety.

BACKGROUND OF THE INVENTION

Women's cosmetics are expensive. There is a need for an efficient and economical way to store and apply cosmetics without wasting cosmetic products that may dry out or spill from a cosmetic dispenser.

FIELD OF THE INVENTION

The invention relates to cosmetic dispensers, and in particular to a plunger-driven cosmetics dispenser.

SUMMARY OF THE INVENTION

An apparatus is disclosed including but not limited to a plunger driven dispenser comprising a handle having an inner section and an outer section and a top; a storage chamber formed inside of the inner section the contains a highly viscous product, wherein the storage chamber has a tapered opening at the bottom and an aperture in the top of the storage chamber, wherein the aperture further comprises a coned tip surrounding the aperture; a syringe and plunger formed inside of the outer section that fits into the storage chamber and extrudes the cosmetic product through the coned tip aperture under pressure applied to the plunger; and an aperture in the top that receives cosmetic product from the storage chamber through the coned tip aperture and a spike to seal the storage chamber.

DETAILED DESCRIPTION

Figure 1:
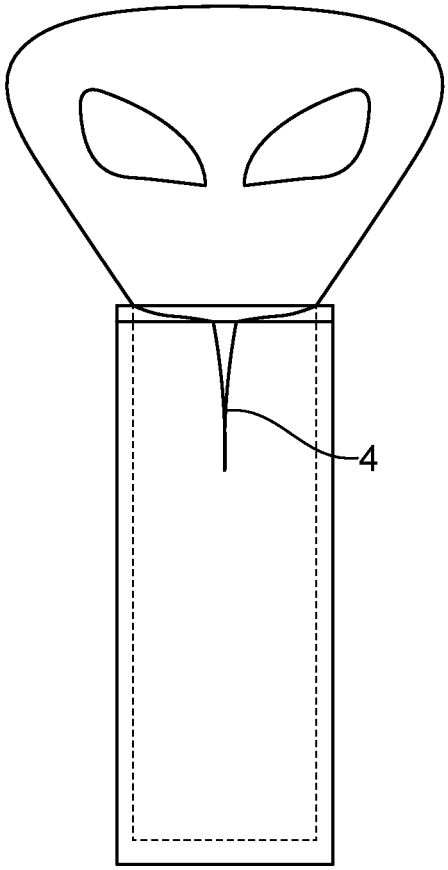
FIG. 1 is side view of a particular illustrative embodiment of the invention wherein a plunger driven cosmetics dispenser is depicted in a storage mode for storing cosmetic product, with a storage top, in this example, an alien head for sealing the cosmetic product in the cosmetics dispenser.

A particular illustrative embodiment of the invention, a plunger-driven type cosmetic dispensing apparatus and method are disclosed herein. In a particular illustrative embodiment of the invention, a cosmetic product dispenser and method for application of cosmetics from the cosmetic dispenser are disclosed herein. The cosmetic product is generally a cosmetic product such as "foundation", the foundation being a highly viscous fluid. The foundation is generally applied to a person's face. The cosmetic dispenser contains the cosmetic product. The cosmetic product is extruded through a hole in the top of the cosmetic dispenser under the influence of a plunger that urges the cosmetic product from a storage chamber formed in the dispenser and onto the application top, a brush head and fibers in this instance. In a particular illustrative embodiment of the invention, a cosmetic brush (also referred to herein as a brush) includes but is not limited to a brush head base and brush fibers extending from the brush head base is provided. The brush head base is shaped similar to an interior surface of a bottle cap. The brush head base has an opening or hole formed in a center of the brush head which allows the foundation to flow from a coned tip aperture in the cosmetic dispenser storage chamber, through the opening formed in the brush head under the influence of the plunger that extrudes the cosmetic product through the coned tip aperture onto the brush head and fibers. The cosmetic product such as a "foundation" flows onto the brush bristles of the brush head for application of the cosmetic product from the brush head fibers to a person's body, usually a person's face.

In a particular illustrative embodiment of the invention, the brush bristles are formed in a "crop circle" shaped pattern, that is, a concentric circle of brush fibers are attached to the circular brush head surrounding a circle of a no bristles area on the brush head and the hole formed in the center of the brush head. The brush works as traditional foundation brush once foundation has been applied from the cosmetic dispenser storage chamber to the brush fibers.

In a particular illustrative embodiment of the invention, the cosmetic product dispenser ("dispenser") includes but is not limited to a two-section handle, the handle having an inner section and an outer section and a plurality of tops. A storage top and an application top are disclosed herein. The storage top (for example, an alien head with a sealing spike) seals the cosmetic product inside of the cosmetic dispenser storage chamber so that the cosmetic product does not dry out or spill from the cosmetic dispenser storage chamber. The application top is a brush that receives the cosmetic product from the dispenser storage chamber for application to a person's face. It should be understood that other products and materials such as body paint can be stored in the dispenser and other application tops, such as a sponge brush, are provided to apply other highly viscous fluids, such as the body paint are attached as an application head to the cosmetics dispenser.

In a particular illustrative embodiment of the invention, a two-part handle is provided for the cosmetic dispenser includes but is not limited to a top-half inner section and a bottom-half outer section. The top half of the two-part handle ("handle") is a hollow inner section formed by a vacancy in a resin molded piece that serves a storage chamber for the cosmetic product inside of a metallic cylinder having a flat top. The resin molded piece and storage chamber are formed inside of a metallic outer shell having a cylindrical shape opened at a lower end and having the flat top with a hole in the center at an upper end of the inner section of the handle. The hole 9 in a center of the flat top of the inner section allows cosmetic product to flow out of the storage chamber in an application mode and allows sealing by a spike inserted into the hole by a storage top, such as the alien head with a spike in the storage mode. The open lower end of the inner section receives a plunger formed on the lower outer section of the dispenser handle. The diameter of the metallic outer shell of the top section of the handle (inner section) is slightly less than the diameter of the outer section of the bottom half of the handle that slides over the inner section.

When the cosmetic dispenser is in storage mode, for storage during travel or when not in use, a storage cap (also referred to herein as a "storage top") is placed over the top of the surface of the cosmetics dispenser and storage chamber. In the present illustrative embodiment, the storage top, for example, an alien head, a spike is provided on the bottom of the alien head so that when the storage top is placed on the top of the two-part dispenser handle of the cosmetics dispenser, the spike enters the hole 9 in the storage chamber and seals the cosmetic product inside of the storage chamber.

The spike enters the hole 9 in the storage chamber, in the present example, the coned tip aperture and seals the storage chamber at the coned tip aperture as the spike engages and touching the coned tip aperture leading into the cosmetic storage chamber. The spike also clears the coned tip aperture as the spike passes through and penetrates the coned tip aperture and prevents the cosmetic product from clogging the coned tip aperture. The spike also substantially prevents the cosmetic product, such as a viscous liquid foundation from drying out during storage. The storage chamber forms a elliptically tapered shaped interior storage chamber having flared out sides at the bottom of the storage chamber (in the present example, the storage chamber is formed out of a hardened resin) and having an aperture, opening, hole or gap in the top of the storage chamber wherein the storage chamber has a coned tip surrounding the aperture (the combination of the storage chamber aperture and the coned tip are referred to herein as a "coned tip aperture") in the storage chamber. The coned tip aperture sticks out and protrudes through the hole 9 metallic surface flat top of the cylindrical handle inner section opening by one millimeter. The coned tip aperture engages a hole 9 in application top, such as the brush handle. The coned tip aperture allows cosmetic product to flow from the storage chamber through the coned tip aperture, through the hole in the storage chamber and onto the application top, (brush head and brush fibers) during an application mode for the cosmetics dispenser. The coned tipped aperture receives a sealing member such as a spike from the storage top (alien head) to seal the cosmetics product inside of the storage chamber during storage mode.

The outer section of the handle is the bottom half of the handle. The outer section forms an outer shell made of the aluminum metallic handle will be slightly wider than the top half (inner section) of the handle. The plunger formed in outer section, bottom half of handle, smoothly slides over the sides of inner section, the top half of the brush. By pushing outer section of the handle upwards, the cosmetic product, such as foundation is extruded from the storage chamber inside of the top half of the handle.

The storage chamber in the top half of the handle holds and stores the cosmetic product, such as a foundation. The bottom half of the handle is used to, not only complete the brush handle as a whole, but also to push the foundation in an upward direction though the storage chamber and coned tip aperture and hole in the brush head onto the brush head base and brush fibers or another application top.

The outer section of the two-part dispenser handle forms the bottom half of the dispenser handle. The bottom half of the dispenser handle is formed with a plunger shaped interior. The plunger shaped interior forms a plunger that is a solid piece. A top surface of the plunger forms a circular, flat section of the plunger. The plunger is encased inside of metallic outer surface of the bottom section of the handle. The metallic handle is like narrow shell. The top of the plunger will be used to push foundation out of top half of the brush. The plunger is shaped and formed to look similar to an upside-down intake valve of a car engine, but not as slim.

Turning now to FIG. 1, FIG. 1 is side view of a particular illustrative embodiment of the invention wherein a plunger-driven cosmetics dispenser shown in storage mode with an alien head spike sealing the cosmetic product in the dispenser storage chamber. As shown in FIG. 1, a storage top 1, in this instance a screw on cap or storage top, for example a top with an alien head attached, having a spike 4, screws on a top 5 of a cylindrical shaped inner section 2 to seal a storage chamber 23 (shown in FIG. 6). The inner section 2 fits inside of a cylindrical shaped outer section 3. In a particular illustrative embodiment of the invention, the storage chamber is made of a hard resin and also has a coned tip aperture formed in the top of the resin storage chamber. The storage chamber can be made of other materials suitable for storage of cosmetic products. In a particular embodiment, the spike 4 is made of a material such as rubber or a pliable plastic or polymer that is softer than the material from which the coned tip aperture is made, thereby facilitating a seal between the spike and the coned tip aperture, caused by deformation and radial compression of the spike as it enters farther into the harder coned tip aperture. The seal between the spike and the coned tip aperture seals the cosmetic product in the storage chamber.

In another particular embodiment, the spike is made of a material that is harder than the material from which the coned tip aperture is made, thereby facilitating a seal between the spike and the coned tip aperture, caused by deformation and radial compression of the softer coned tip aperture as the spike enters the coned tip aperture.

The spike 4, is a longitudinally tapered spike 4 having a longitudinal axis that is perpendicular to a plane passing through the storage tank storage top bottom surface. The spike is fixed to the bottom of the storage top and extends along the spike's longitudinal axis from the bottom of the storage top at a perpendicular angle from a plane formed in the bottom of the storage top bottom surface. As the storage head is screwed onto the storage chamber top, the tapered spike is inserted into a storage chamber coned tip aperture to seal the storage chamber aperture. A diameter of the tapered spike, measured along and perpendicular to the longitudinal axis of the spike, is increasing larger from the bottom tip of the spike to the top of the spike where the spike is attached to a bottom surface of the storage top. The diameter of the spike is slightly larger than the diameter of the storage chamber coned tip aperture at a point where the spike contacts the interior sides of the storage chamber coned tip aperture after the storage top is screwed down in place on the storage chamber top. In a particular embodiment illustrative embodiment, the spike is made of a material softer than the harder resin storage chamber and the coned tip aperture on the storage chamber so that the spike is both flexible and compressible. The soft sides of the spike are radially compressed when the spike extended down into the storage chamber aperture to the point where the spike diameter is greater than the diameter of an interior diameter of the coned tip aperture in the storage chamber so that the sides of the spike are radially compressed by the smaller diameter storage of chamber coned tip aperture, providing a seal between the compressed spike and the storage chamber coned tip aperture. In a particular embodiment the spike is made of a flexible and compressible material so that the spike flexes to allow angular deflection of the spike when aligning spike and storage top with the coned tip aperture and securing the storage top on the top of the cosmetic dispenser for storage.

In another particular embodiment of the invention, the coned tip aperture is a separate piece from the storage chamber, wherein the coned tip aperture has the same shape but is installed separately into the inner section and allows fluid flow from the storage chamber through a hole in top of the storage chamber where the separate piece coned tip aperture connects to allow flow from the storage tank through the separate piece onto a brush head or to receive a sealing spike from storage top.

Figure 2:
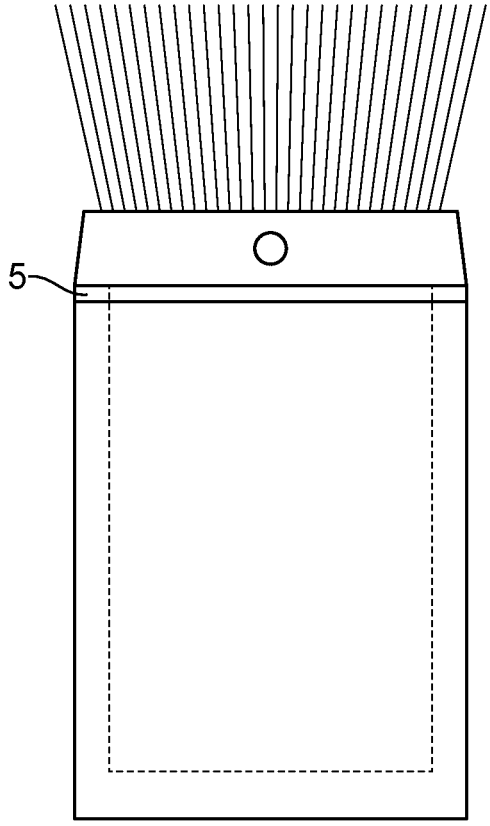
FIG. 2 is a side view of a particular illustrative embodiment of the invention wherein a plunger driven cosmetics dispenser is shown in application mode for applying cosmetic product to a person's face, shown with an application top, in this example, a cosmetic brush for receiving the cosmetic product from a storage chamber in the cosmetic dispenser for application of the cosmetic product to a person's face from the brush attached to a dispenser.

Turning now to FIG. 2, FIG. 2 is a side view of a particular illustrative embodiment of the invention wherein a plunger driven cosmetics dispenser in application mode with a brush receiving cosmetic product for application the cosmetic product to a person's face from a brush attached to a dispenser. As shown in FIG. 2, an application head (in this instance a brush) having a brush head 6 and fibers 7. A hole 8 in the brush head is aligned with the coned tip aperture of the storage chamber. The coned tip aperture 18 extends through the brush head hole 9 and protrudes through the brush head hole and through the top of the brush head by about 1 millimeter. The cosmetic product is urged from the storage chamber through the coned tip aperture and hole 9 and flows onto the brush head 6 and brush bristles 7 for application to a person.

Figure 3:
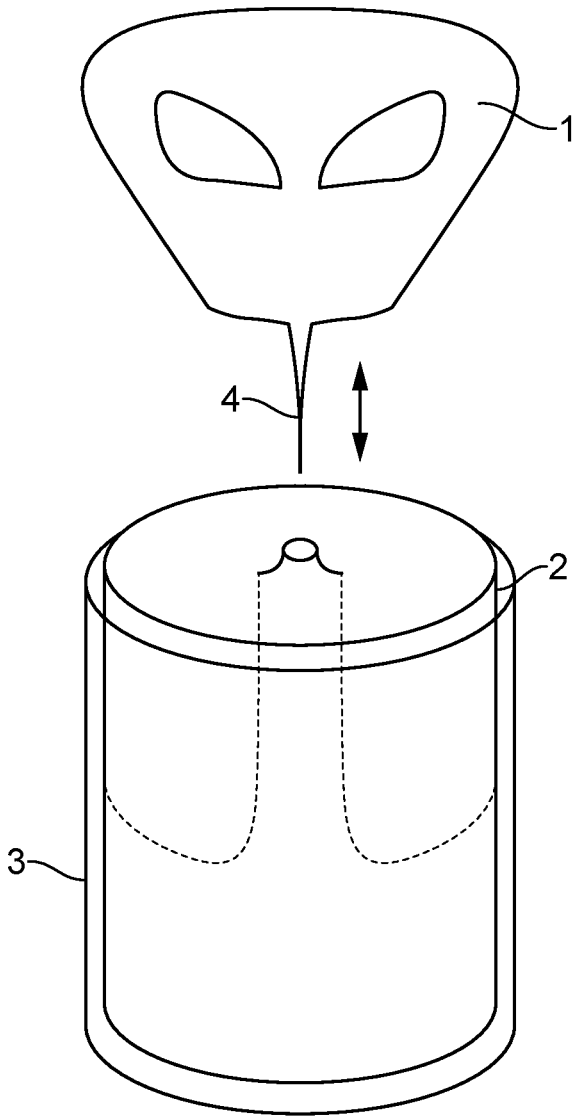
FIG. 3 is side view of a particular illustrative embodiment of the invention wherein a plunger driven cosmetics dispenser is shown in a storage mode with an alien head storage top having a spike for sealing the cosmetic product in the storage chamber in the cosmetic dispenser.

Turning now to FIG. 3, FIG. 3 is side view of a particular illustrative embodiment of the invention wherein a plunger driven cosmetics dispenser in storage mode with an alien head storage top sealing cosmetic product in a storage chamber in the cosmetics dispenser. As shown in FIG. 3, the spike 4 attached to the bottom of the storage top moves down into the coned tip aperture 18 as the storage top is screwed onto the cosmetic dispenser top 5.

Figure 4:
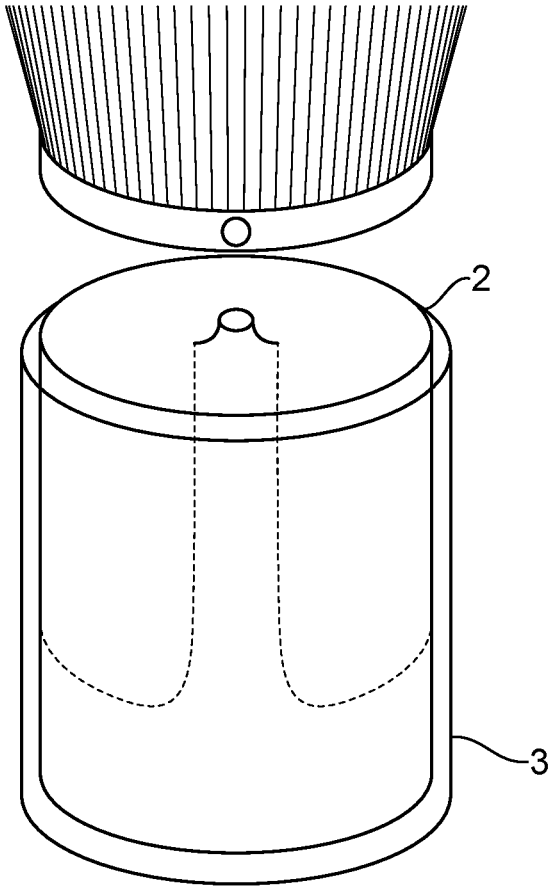
FIG. 4 is a side view of a particular illustrative embodiment of the invention wherein the plunger driven cosmetics dispenser in application mode with an application top, in this example, a cosmetic brush attached for receiving cosmetic product for application of the cosmetic product to a person's face from a cosmetics brush attached to a top of the cosmetics dispenser.

Turning now to FIG. 4, FIG. 4 is a side view of a particular illustrative embodiment of the invention wherein a plunger driven cosmetics dispenser in application mode with a brush receiving cosmetic product for application the cosmetic product to a person's face from a brush attached to a dispenser. As shown in FIG. 4, the application top brush head has a hole 9 formed in the brush head that receives the coned tip aperture of facilitation of cosmetic flow from the storage chamber onto the brush head and brush head fibers. The coned tip aperture protrudes through the hole 9.

Figure 5:
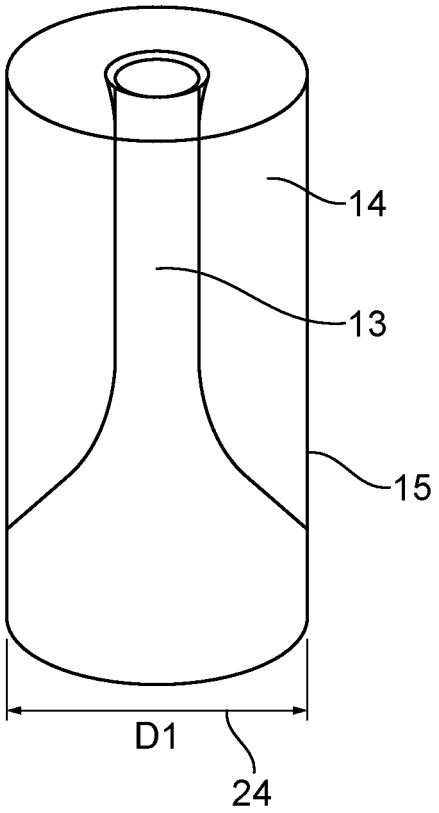
FIG. 5 is a side view of a particular illustrative embodiment of the invention wherein a plunger is shown inside of the cosmetics dispenser that pushes the cosmetic product from the storage chamber inside of the cosmetic product dispenser through a hole in the top of the cosmetic dispenser.

Turning now to FIG. 5, FIG. 5 is a side view of a particular illustrative embodiment of the invention wherein a plunger that pushes a cosmetic product from a cosmetic product dispenser through a hole in the top of a cosmetic dispenser. As shown in FIG. 5, a solid plunger 13 (made of resin in this example) is formed inside the metallic side wall 15 of the outer section of the brush handle. The outer section of the of the brush handle has an interior diameter, D1 24. In a particular embodiment D1 is ½ inch. An interior hollow space 14 is between the side wall 15 and the plunger 13. The plunger 13 and hollow space 14 fit into an opening 16 and the side wall 15 slides over the outside diameter, D2 25 of the inner section. In a particular embodiment the outside diameter D2 is 15⁄32 of an inch so that the outer section slides over the inner section and allows pushing the plunger upward into the storage chamber.

Figure 6:
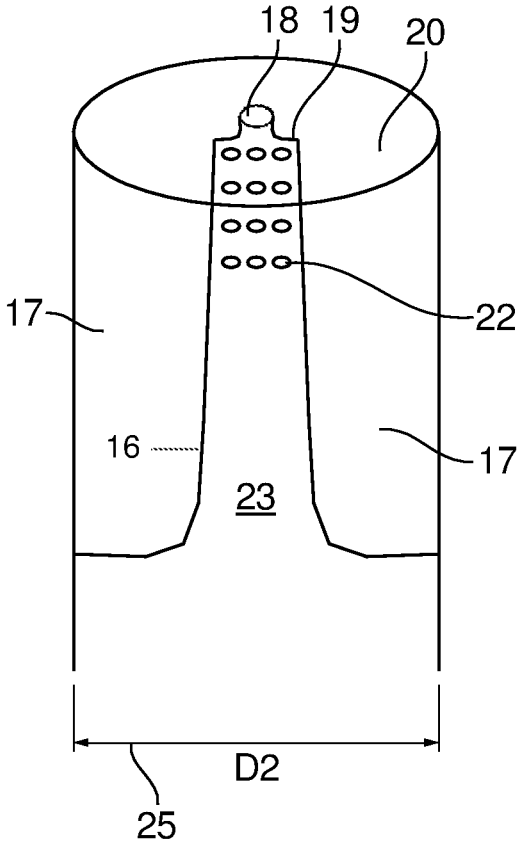
FIG. 6 is a side view of a particular illustrative embodiment of the invention wherein a cosmetic dispenser the contains a cosmetic product that is extruded through a hole in the top of the storage chamber inside of the cosmetic dispenser, wherein the plunger pushes the cosmetic product from the storage chamber inside of the cosmetic product dispenser through a hole in the top of the cosmetic dispenser.

Turning now to FIG. 6, FIG. 6 is a side view of a particular illustrative embodiment of the invention wherein a cosmetic dispenser the contains a cosmetic product that is extruded through a hole in the top of cosmetic dispenser, wherein a plunger pushes and extrudes a cosmetic product from the cosmetic product dispenser storage chamber through a hole in the top of a cosmetic dispenser. As shown in FIG. 6, in a particular illustrative embodiment, an elliptically tapered opening 16 is formed for reception of the plunger 13. The opening 16 is shaped to conform to the shape of the plunger. A storage chamber 23 is formed as part of the opening 16. The coned tip aperture 18 is formed as part of the storage chamber. The storage chamber contains foundation 22 for dispensing to a brush head through coned tip aperture. A hole 8 is formed in the brush head to receive flow of cosmetic product from the storage chamber. The elliptical opening 16 makes it easy to fill the storage chamber with cosmetic product and easy to clean the storage chamber for replacement of the cosmetic product with a different product, such as body paint or another cosmetic product.

Figure 7:
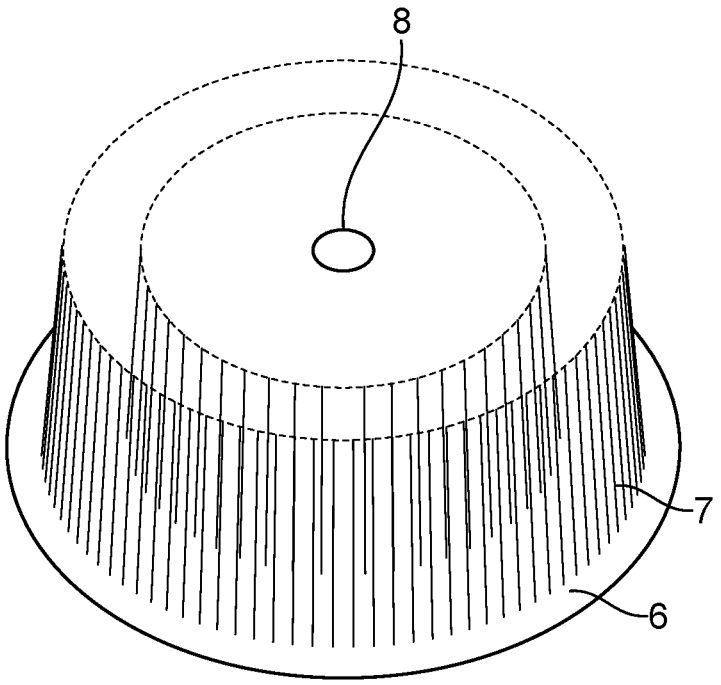
FIG. 7 is a prospective view of a particular illustrative embodiment of the invention wherein a brush having a circular pattern of bristles that form a concentric circle pattern of brush fibers on the brush top of the cosmetics dispenser, wherein the brush fibers surround a circular pattern formed by an absence of bristles in the center of the circle of bristles.

Turning now to FIG. 7, FIG. 7 is a prospective view of a particular illustrative embodiment of the invention wherein a brush having a circular pattern of bristles wherein the bristles form a concentric circle on the top of the cosmetics dispenser having an absence of bristles in the center of the circle of bristles. As shown in FIG. 7, a brush head base 6 has an opening in the brush head base to receive foundation from the storage chamber coned tip aperture. Bristle fibers 7 are formed in a circular pattern surrounding the hole 18 in the brush head. This circular pattern of brush bristles placed on the brush head, is referred to herein as a crop circle pattern.

Figure 8:
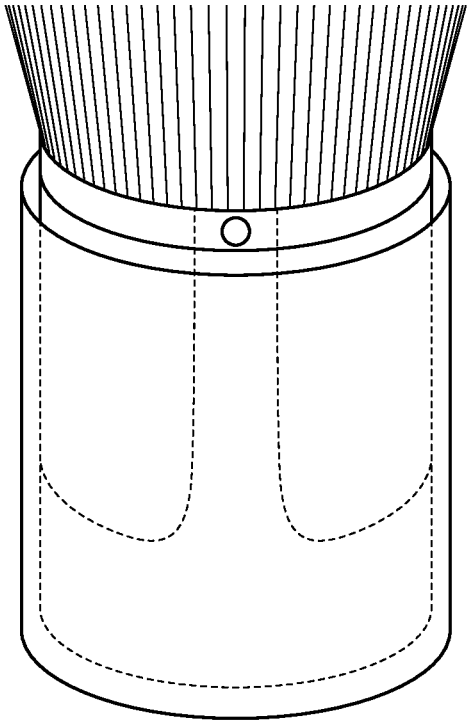
FIG. 8 is a perspective view of a schematic depiction of the cosmetic dispenser in application mode.
Figure 9:
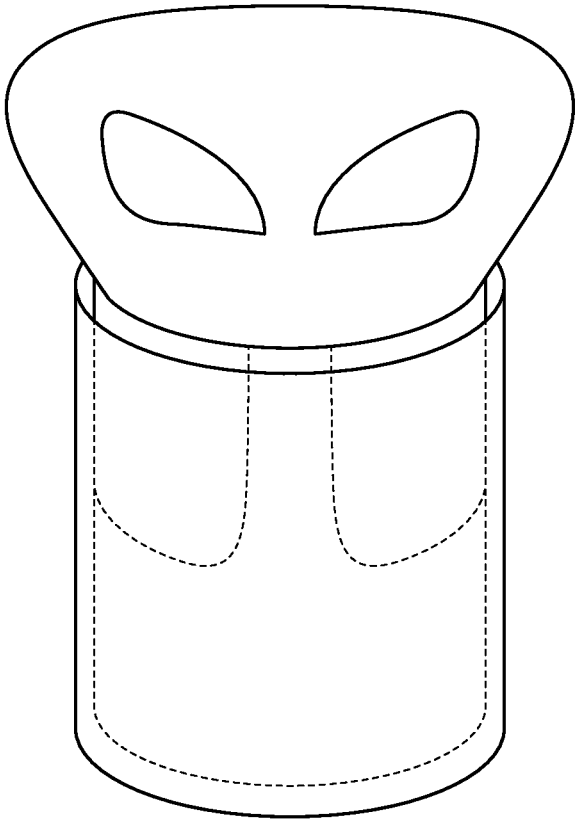
FIG. 9 is a perspective view of a schematic depiction of the cosmetic dispenser in storage mode.

FIG. 8 is a perspective view of a schematic depiction of the cosmetic dispenser in storage mode. FIG. 9 is a perspective view of a schematic depiction of the cosmetic dispenser in application mode.

Figure 10:
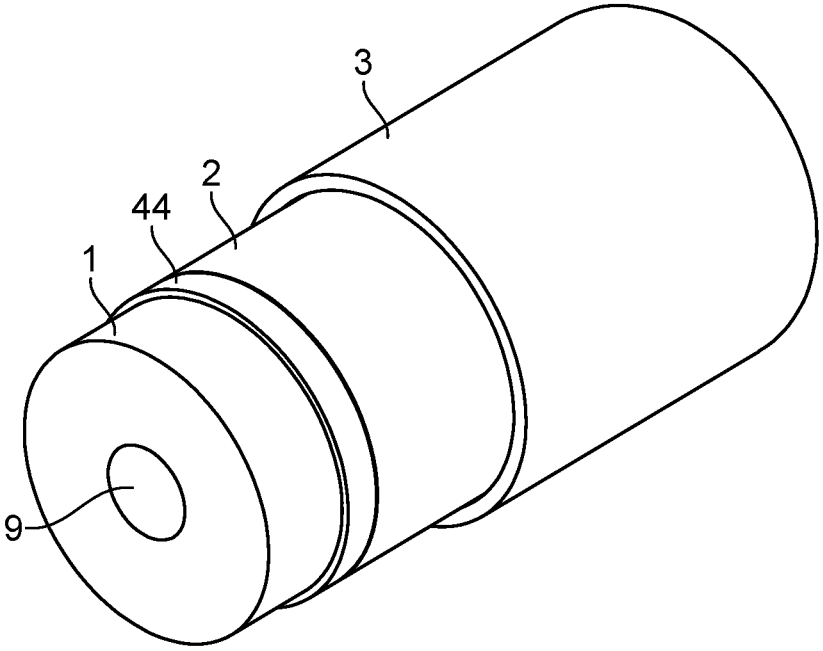
FIG. 10 is side view of a particular illustrative embodiment of the invention wherein a plunger driven cosmetics dispenser.

Turning now to FIG. 10, FIG. 10 is side view of a particular illustrative embodiment of the invention wherein a plunger driven cosmetics dispenser. FIG. 10 is side view of a particular illustrative embodiment of the invention wherein a plunger-driven cosmetics dispenser shown in storage mode with a plunger sealing the cosmetic product in the dispenser storage chamber. As shown in FIG. 10, a storage top 1, in this instance a screw on cap or storage top, for example a top with an alien head attached, having a spike 4 (see FIG. 3), screws on a top 5 of a cylindrical shaped inner section 2 to seal a storage chamber 23 (shown in FIG. 6). The inner section 2 fits inside of a cylindrical shaped outer section 3. A plunger is advanced into the storage chamber by rotating the outer section 3 on threads 1402 shown on FIG. 14.

Figure 11:
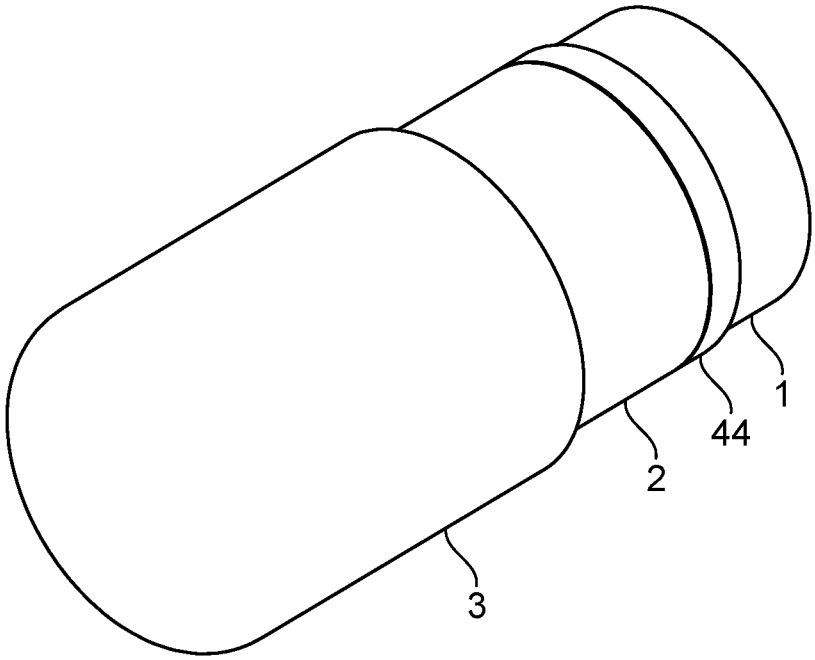
FIG. 11 is side view of a particular illustrative embodiment of the invention wherein a plunger driven cosmetics dispenser.

FIG. 11 is side view of a particular illustrative embodiment of the invention wherein a plunger driven cosmetics dispenser shown in FIG. 10.

Figure 12:
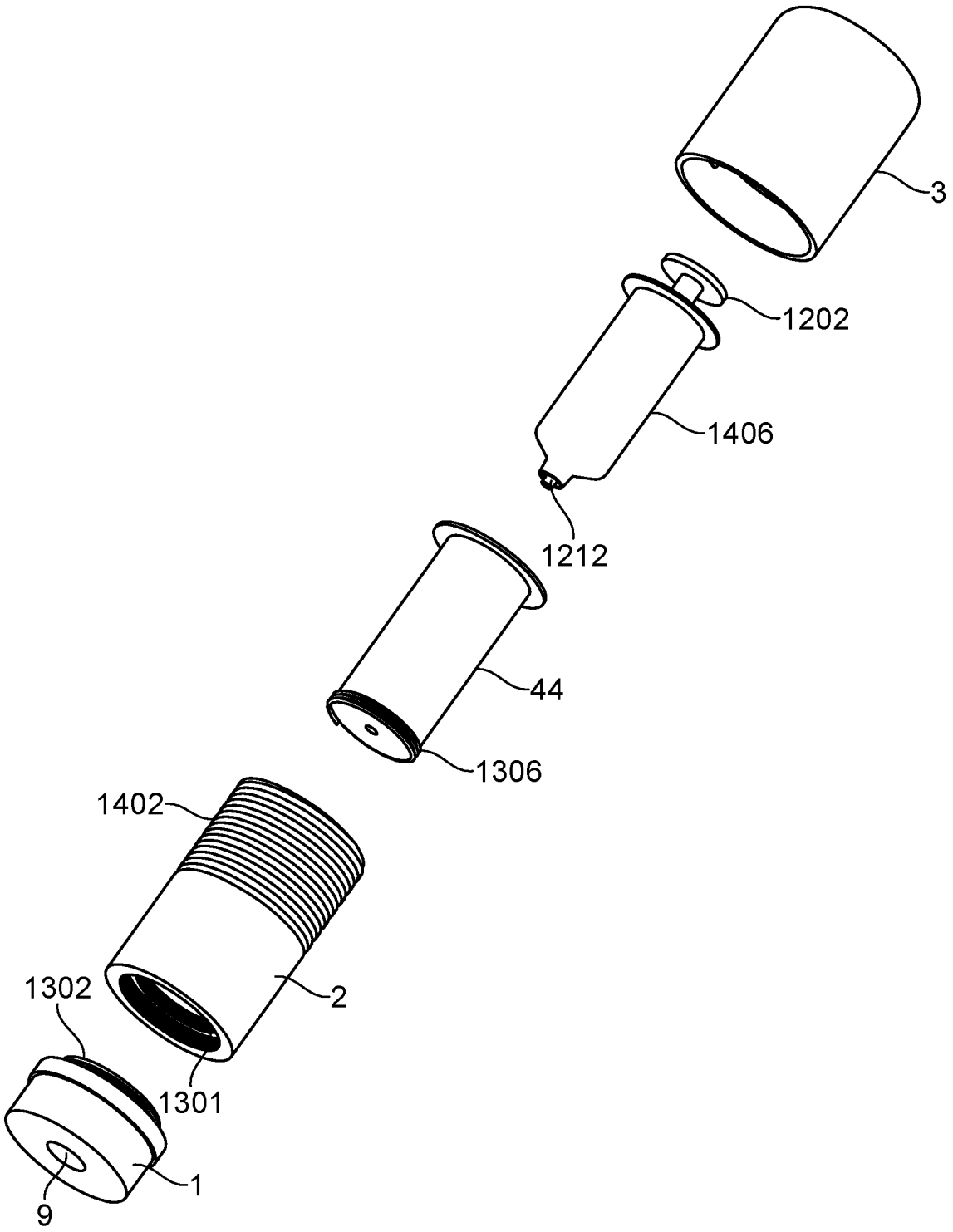
FIG. 12 is side view of a particular illustrative embodiment of the invention wherein a plunger driven cosmetics dispenser.

FIG. 12 is exploded view of a particular illustrative embodiment of the invention wherein a plunger driven cosmetics dispenser. As shown on FIG. 12, a plunger 1202 is advanced into syringe barrel 1406 inside of storage chamber 44 to force cosmetic product, tanning product, lotions or any skincare product out of hole 9 from storage in storage chamber 44. As shown in FIG. 12, inner section 2 has threads 1301 that screw into threads 1302 formed in top 1. Storage chamber 44 threads 1306 into threads 1301.

Figure 13:
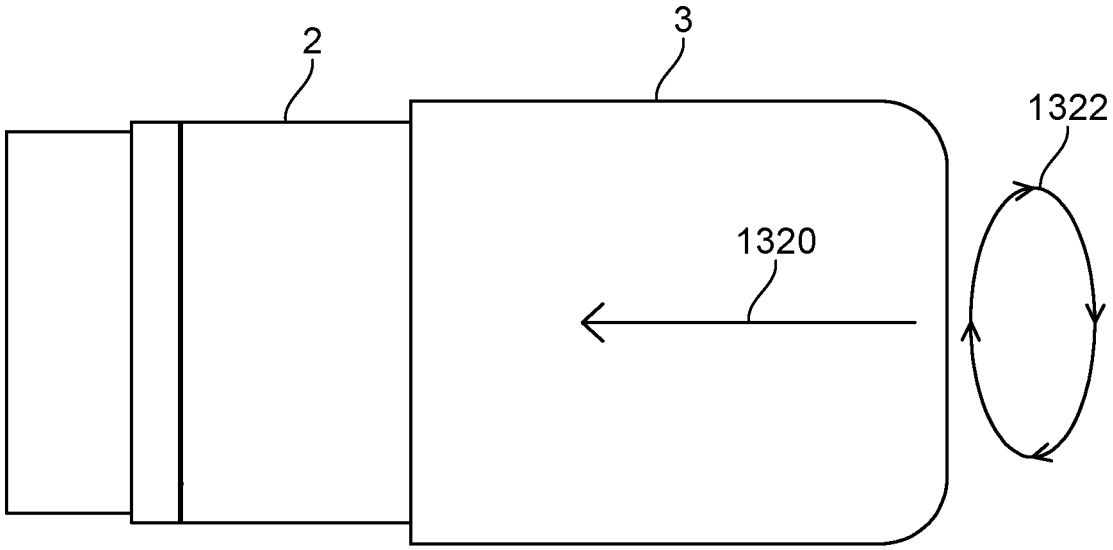
FIG. 13 is side view of a particular illustrative embodiment of the invention wherein a plunger driven cosmetics dispenser.

FIG. 13 is side view of a particular illustrative embodiment of the invention wherein a plunger driven cosmetics dispenser. As shown in FIG. 13, rotating outer shell 3 advances the outer shell along the longitudinal axis 1320 of the storage chamber and pushed plunger along path 1320 inside of the storage chamber to force the cosmetic product out of hole 9.

Figure 14:
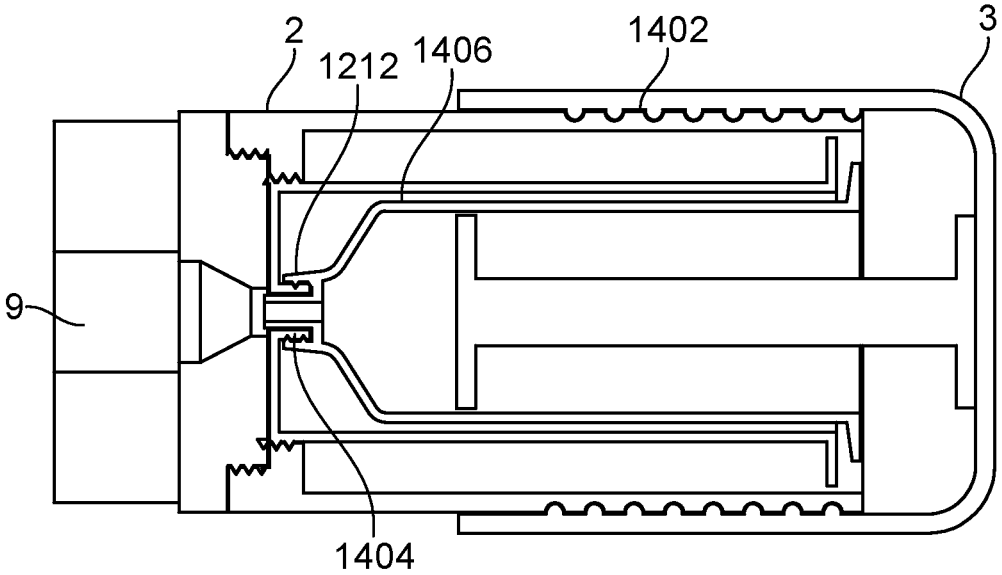
FIG. 14 is side view of a particular illustrative embodiment of the invention wherein a plunger driven cosmetics dispenser.

FIG. 14 is side view of a particular illustrative embodiment of the invention wherein a plunger driven cosmetics dispenser. Syringe barrel 1406 has threaded tip 1212 having threads 1404 in storage chamber receptacle 1406 that screw into mating threads in storage chamber. Outer shell 3 rotates on threads 1402 on outer shell 3 and inner section 2 to advance syringe plunger 1202.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived there from, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. An apparatus comprising:

a plunger driven dispenser comprising a handle having an inner section and an outer section and a top;

a storage chamber formed inside of the inner section that contains a highly viscous product, wherein the storage chamber has an aperture in the top of the storage chamber;

a plunger formed inside of the outer section that fits into the storage chamber and extrudes the highly viscous product through a coned tip aperture under pressure applied to the plunger;

wherein a threaded outer section rotates on threads on the inner section to advance the plunger inside of a syringe inside of the storage chamber;

an aperture in the top that receives highly viscous product from the storage chamber through the coned tip aperture.

2. The apparatus of claim 1, wherein the syringe has a threaded tip that screws into the inner section.

3. The apparatus of claim 2, wherein the spike is made of material softer than a coned tip aperture so that the spike is compressed by the coned tip aperture to seal the highly viscous product in the storage chamber.

4. The apparatus of claim 3, wherein the spike is flexible to provide angular deflection of the spike when aligning the storage top for placement of the storage top on the top of the cosmetic dispenser.

5. The apparatus of claim 4, wherein the spike is made of material harder than the coned tip aperture so that the coned tip aperture is compressed by the spike to seal the highly viscous product in the storage chamber.

6. The apparatus of claim 1 wherein the top comprises an application top comprising brush base and brush fibers attached to the brush base, wherein the coned tip aperture protrudes through a hole in the brush base for flowing highly viscous product from the storage chamber onto the brush base and brush fibers.

7. The apparatus of claim 6 wherein the inner section further comprises a metallic cylindrical shell surrounding the storage chamber, wherein the top of the inner section has a flat top and an aperture in a middle of a flat top for receiving highly viscous product from the coned tip aperture in the storage chamber.

8. The apparatus of claim 7, wherein the brush fibers from a concentric circle of fibers surrounding the hole in a middle of the brush base.

9. The apparatus of claim 1, wherein the coned tip aperture is a separate piece from the storage chamber, wherein the storage chamber has an aperture in the top of the storage chamber that aligns with the coned tip aperture for extruding highly viscous product onto the brush base and brush fibers.

10. The apparatus of claim 1, wherein the highly viscous product is cosmetic foundation.

11. The apparatus of claim 1, wherein the highly viscous product is body paint.

12. The apparatus of claim 1, wherein the top is sponge application top.

13. A method for storing a highly viscous product in a plunger driven dispenser comprising a handle having an inner section and an outer section and a top, having a storage chamber formed inside of the inner section that contains a highly viscous product, wherein the storage chamber has an aperture in a top of the storage chamber, and a syringe and plunger formed inside of the outer section that fits into the storage chamber and extrudes the highly viscous product through the aperture under pressure applied to the plunger and an aperture in the top that receives highly viscous product from the storage chamber, the method comprising rotating the outer section over the inner section to advance the plunger to extrude the highly viscous product from the storage chamber.

14. The method of claim 13, wherein the top is a storage chamber top, the method further comprising, placing the storage chamber top on the top of the storage chamber so that the top seals the aperture.

15. The method of claim 14, wherein a spike is made of material softer than the coned tip aperture so that the spike is compressed by the coned tip aperture to seal the highly viscous product in the storage chamber.

16. The method of claim 15, wherein the spike is flexible to provide angular deflection of the spike when aligning the storage chamber top for placement of the storage chamber top on the top of the cosmetic dispenser.

17. The method of claim 16, wherein the spike is made of material harder than the coned tip aperture so that the coned tip aperture is compressed by the spike to seal the highly viscous product in the storage chamber.

18. The method of claim 13 wherein the top comprises an application top comprising brush base and brush fibers attached to the brush base, wherein a coned tip aperture protrudes through a hole in the brush base for flowing highly viscous product from the storage chamber onto the brush base and brush fibers, the method further comprising sliding the outer section over the inner section to advance the plunger into the storage chamber to extrude the highly viscous fluid from the storage chamber, through the coned tip aperture onto the brush base and brush fibers.

19. The method of claim 13, wherein a coned tip aperture is a separate piece from the storage chamber, wherein the storage chamber has an aperture in the top of the storage chamber that aligns with the coned tip aperture for extruding highly viscous product onto the brush base and brush fibers.

20. The method of claim 13 wherein the inner section further comprises a metallic cylindrical shell surrounding the storage chamber, wherein the top of the inner section has a flat top and an aperture in a middle of a flat top for receiving highly viscous product from the coned tip aperture in the storage chamber.

* * * * *